United States Patent [19]

Watanabe et al.

[11] Patent Number: 4,683,022

[45] Date of Patent: Jul. 28, 1987

[54] AUTOMATIC DEVICE FOR PREPARING PAPER ROLLS FOR WEB PASTING

[75] Inventors: Takemi Watanabe, Toyonaka; Noriyuki Shiba, Tokyo, both of Japan

[73] Assignee: Kabushiki Kaisha Kaneda Kikai Seisakusho, Tokyo, Japan

[21] Appl. No.: 855,298

[22] Filed: Apr. 24, 1986

[30] Foreign Application Priority Data

Apr. 26, 1985 [JP] Japan ..... 60-92074
Jun. 7, 1985 [JP] Japan ..... 60-86670[U]
Aug. 22, 1985 [JP] Japan ..... 60-128316[U]

[51] Int. Cl.[4] ..... B31F 5/06; B65H 19/18

[52] U.S. Cl. ..... 156/505; 156/504; 156/506; 156/510; 156/521; 156/584; 242/56 R; 242/58.1; 242/58.3; 242/58.5

[58] Field of Search ..... 156/504, 521, 446, 584, 156/157, 159, 505, 506, 510; 242/58.1, 58.2, 58.3, 58.5, 56 R

[56] References Cited

U.S. PATENT DOCUMENTS

| | | | |
|---|---|---|---|
| 2,596,189 | 5/1952 | Wieking | 242/58.2 |
| 3,001,735 | 9/1961 | Francik | 242/58.2 |
| 3,740,296 | 6/1973 | McDonald | 242/58.1 |
| 3,901,757 | 9/1975 | Eglinton | 156/522 |
| 4,278,489 | 7/1981 | Horsley | 242/58.2 |
| 4,543,152 | 9/1985 | Nozaka | 156/504 |

*Primary Examiner*—Michael Wityshyn
*Assistant Examiner*—Lou Simmons
*Attorney, Agent, or Firm*—Griffin, Branigan & Butler

[57] ABSTRACT

The present invention relates generally to equipment for a printing system for newsprint and the like and, more particularly, to a device for automatically preparing leading web ends of paper rolls for automatic web pasting.

A device embodying the present invention is supported generally from a ceiling of a room and extends downwardly when used. The device comprises a structural support which is both vertically extensible and collapsible, an arm extended sideways and capable of movement in directions both parallel to and perpendicular to the axis of a paper roll, a suction cup device for lifting the outermost web of the paper roll, a cutter device for cutting the paper web of the paper roll, a device for adhesively attaching web pasting adhesive tapes to the web's leading end, a device for adhesively attaching a head of a web end-fastening strip to an inner side of the web's leading end, and a paper roll-pressing device for adhesively fastening a tail of the web end-fastening strip to the outer surface of the web. A paper roll prepared for web pasting according to the present invention is rotated at a set rate on a reel stand. By pressing the expiring web being fed into a printing machine against the leading web end thus prepared with adhesive of the rotating paper roll, the expiring web is adhesively pasted to the leading web end of the new paper roll. This method of adhesive-based web pasting enables the printing machine to be fed with paper continuously.

7 Claims, 22 Drawing Figures

AUTOMATIC DEVICE FOR PREPARING PAPER ROLLS FOR WEB PASTING

BACKGROUND OF THE INVENTION

The present invention relates to a device that, when a paper roll being fed into a printing machine reaches its end (is expiring), it automatically prepares the leading web end of a new roll for automatic web-to-web pasting by means of an adhesive.

As shown in FIG. 10, a printing system for newspapers or the like includes a printing machine C which is generally fed with a paper web from one of a plurality of paper rolls B rotatively held on a reel stand A. When a paper roll B1 being fed into the printing machine C is expiring, a new paper roll B2 positioned nearest to it, is started rotating by a drive device D and made to rotate at a rate peripherally equal to the rate at which the expiring paper B1 is being fed. A pusher E is then made to press the trailing end of the expiring web from the paper roll B1 against the leading end of the new paper roll B2 so as to paste the two webs to each other by means of adhesive.

Connection of the new paper roll B2 to the expiring roll B1 requires that the leading web end of the new roll be prepared beforehand for this adhesive-based pasting. Conventionally, it has been the practice to prepare new paper rolls for pasting entirely by manual procedure substantially in the manner described below, to make a leading web end assume the form shown in FIG. 11.

(1) In order to remove from the paper roll any loose portion or damaged area that may have been caused thereto in transit, the paper roll is stripped of peripheral layers (three to five layers from the peripheral surface) with a spatula or the like;

(2) the leading web end is cut with scissors or the like into a substantially triangular form to adapt it for the pasting;

(3) the tip of the web edge thus formed is fastened to the peripheral surface of the paper roll B by means of an adhesive web edge fastening strip F.

(4) strips of adhesive tape G for adhesion in pasting are adhesively attached to the V-shaped leading web end.

The manual process to carry out all of these steps has been very inefficient and costly as well. Another problem has been an excessive loss of paper incidental to the manual process because the manual removal of the peripheral layer is liable to damage inner layers that otherwise are good for use.

SUMMARY OF THE INVENTION

The present invention has been developed with a view to solving the above-mentioned problems that are generally involved in the manual preparation of paper rolls for pasting, and purports to accomplish the following objects:

the first object is to provide a device for preparing leading web ends for pasting paper rolls whereby the required preparation is carried out entirely automatically and with high efficiency and accuracy;

the second object is to provide a device as described above, whereby the required web preparation is carried out without causing a large loss of printing paper;

the third object is to provide a device as described above, whereby the required web preparation can be carried out while the paper roll to be prepared is rotatably held on a reel stand in a printing system;

the fourth object is to provide a device as described above, which is collapsible and designed to be suspended at an adjustable height from the ceiling in a room so that the installation requires little room on the floor.

To meet each of these objects, there is provided a device embodying the present invention which comprises an extensible and collapsible structural suspension support for suspending from above a main preparing device for paper roll pasting. The main preparing device is mounted on an arm held by the suspension support so that its foremost end is capable of being moved in directions both parallel to and perpendicular to an axis of a paper roll. The main preparing device includes a suction cup device designed to lift up the outermost web of the paper roll, a cutter device designed to cut the web of the paper roll, and an adhesive tape-attaching device designed to adhesively attach strips of adhesive tape for web pasting to the leading end of the paper roll. A table assembly is held by the suspension support and positioned under the arm. A web edge fastening strip-attaching device is also held by the suspension support and is positioned under the table assembly to adhesively attach the head of a fastening strip to the lower side of the leading web end. Paper roll-pressing devices are also included for adhesively attaching the tail of the fastening strip to the peripheral web at a position adjacent to the leading web end.

The above-mentioned device is designed to operate in the following manner:

(1) The vertically collapsible suspension support, whose top is attached to a structure such as, for example, a ceiling of a building, is extended downwards so as to bring the main preparing device to a position close to the paper roll on the reel stand;

(2) the vacuum suction cup is pressesd against the leading web end at a suitable position and lifts up the outermost web layer;

(3) a blade of the cutter device is inserted from a fringe into an opening produced by the lifting of the outermost web layer and is then moved breadthwise to cut the web across;

(4) the paper roll is turned so as to remove the cut-off portion of the web from the machine and to draw the leading web end onto the table assembly;

(5) a blade of the cutter device is applied to the web end and moved in such a manner as to produce a substantially V-shaped incision in the web so that the web edge assumes the shape of an angle of a triangle;

(6) an adhesive tape-attaching device is activated to adhesively attach strips of adhesive tape for web pasting to the outer surface of the V-shaped leading web end;

(7) simultaneously with the above-mentioned process, the web edge fastening strip-attaching device, positioned under the table assembly, is activated to adhesively attach the head of a fastening strip, from under the table assembly, to the inner side of the tip of the V-shaped leading web end; and (8) the paper roll is turned backward to draw back the leading web end from the table assembly so that the cut-off portions adjoining the V-shaped web end are removed and with the web end drawn back on the paper roll the tail of the web edge fastening strip stuck to the web end as described above is adhesively attached to the peripheral web at a position adjacent to the web end under pressure from a paper roll-pressing device.

In practice, a device embodying the present invention exhibits the following advantages:

(1) the peripheral layers can be removed for a set length from a paper roll and therefore, less printing paper is wasted;

(2) the removal of the peripheral layers from a paper roll can be performed without causing damage to the remaining inner web, and therefore, there occurs no loss of paper that otherwise may possibly be caused at the time of removal of the peripheral layers;

(3) since paper rolls can be automatically prepared for web pasting with accuracy, the device therefore affords economy with respect to cost and assurance against faults with respect to the work, as compared to manual preparations;

(4) since the reel stand constituting a part of a printing system is availed of and the processing device is held from above generally by the ceiling, the processing equipment can be made smaller and requires little space for installation;

(5) the practice of the present invention dispenses with any additional supporting devices or special drive means for paper rolls, and moreover, a single table board capable of being slid in opposite directions permits preparation of paper rolls on two reel stands placed on opposite sides with the preparing device in the middle; therefore, the cost of equipment can be reduced to a great extent;

(6) the attachment of a web edge fastening strip for web end fastening is performed simultaneously with formation of the V-shaped incision and the attachment of adhesive tape for web pasting so that the time needed for paper roll preparation for pasting is greatly shortened; and (7) fully automatic paper roll pasting becomes possible because a protective coating-film overlaying adhesive tape for web pasting is removed when the tape is applied to the web end.

BRIEF DESCRIPTION OF THE DRAWINGS

The foregoing and other objects, features and advantages of the inventon will be apparent from the following more particular description of a preferred embodiment as illustrated in the accompanying drawings in which reference characters refer to the same parts throughout the various views. The drawings are not necessarily to scale, emphasis instead being placed upon illustrating the principles of the invention.

DETAILED DESCRIPTION OF THE INVENTION

Figure 1:
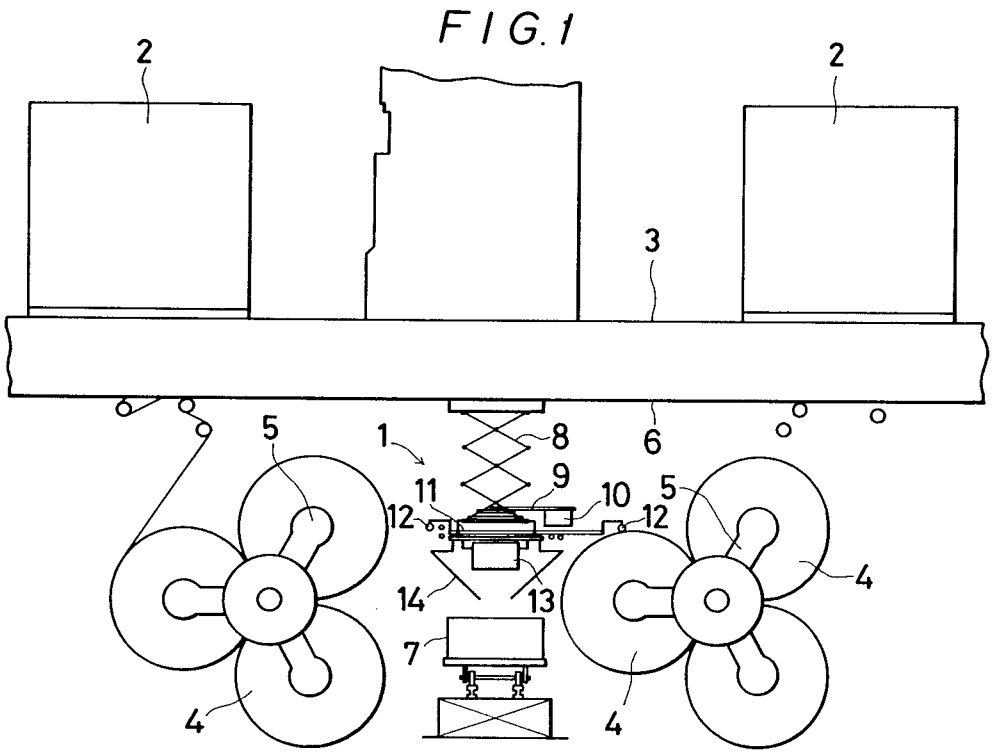
FIG. 1 shows schematically an elevational view of an integrated preparing device of this invention in a paper feeding setup of a printing system.

Referring now to FIG. 1, there is shown a device embodying the present invention installed in position in a schematic elevational representation. In FIG. 1 is shown an integrated device 1 for preparing web pasting; a printing machine 2; a floor 3 on which the printing machine is installed; paper rolls 4; a reel stand 5; a ceiling 6 of the room; and a vehicle 7 conveying paper rolls.

The integrated device 1 is held by the ceiling 6 in a position adjacent to and between the reel stands 5, and is capable of being folded up and extended downward. This integrated device 1 comprises essentially a structural support 8 which is vertically collapsible, an arm 9, a main preparing device 10, a table assembly 11, paper roll-pressing devices 12, a web edge fastening strip-attaching device 13, and a hopper 14.

The vertical collapsible structural support 8 is similar in mechanism to pantographs and is manipulated by a hydraulic cylinder drive or an electric motor drive (not shown in the drawings). This suspension support 8 suspends the arm 9, the main preparing device 10, the table assembly 11, etc. and lowers and raises them as desired. A hydraulic cylinder mechanism can also be employed as a substitute for the pantograph-like mechanism of the structural support 8.

Figure 2:
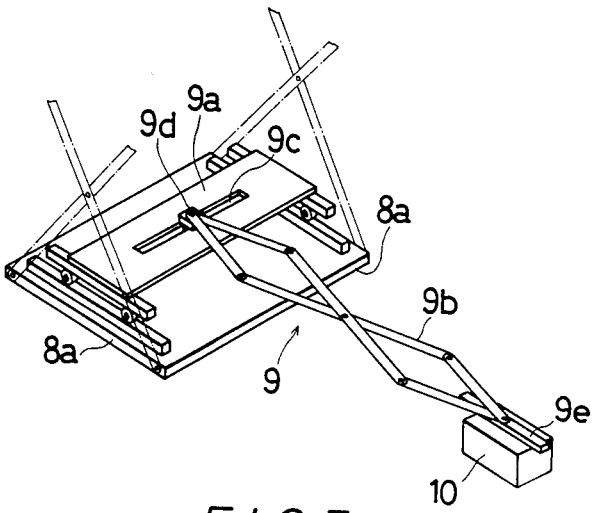
FIG. 2 is a schematic perspective view of an arm forming part of the integrated preparing device of FIG. 1.

As shown in FIG. 2, the arm 9 comprises a truck **9*a* held on a support board 8*a* at the lowest end of the support 8 and is movable in directions prependicular to the axis of the paper roll 4 and an arm proper 9*b* which folds and extends in the same directions as the truck 9*a*. The arm proper 9*b* is held on a pivot 9*d* which is fitted in a groove 9*c* in the truck 9*a*, so that the arm proper 9*b* can be moved in directions parallel to the axis of the paper roll as well as revolved horizontally on the pivot 9*d*. The main preparing device 10 is suspended from the foremost end of the arm proper 9*b* with a guide rail 9*e*** therebetween which permits the device to move in directions perpendicular to the axis of the paper roll.

Figure 3:
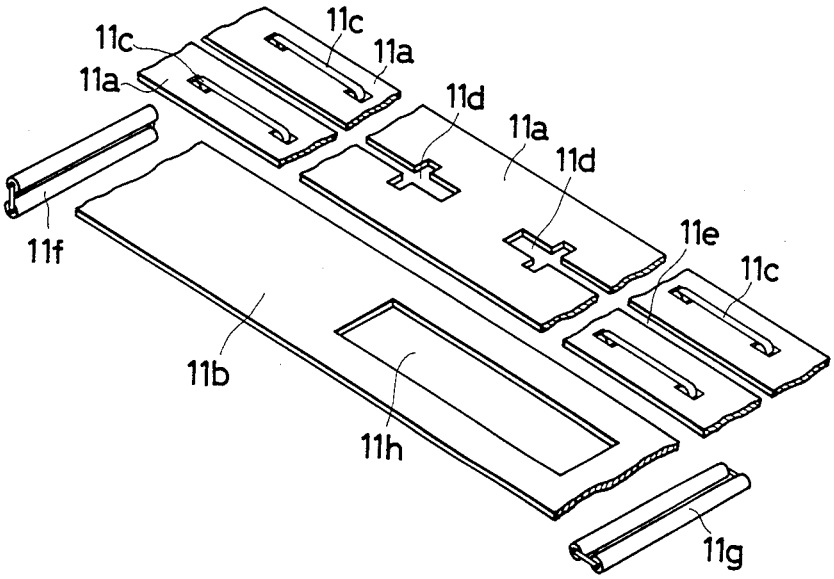
FIG. 3 is a schematic perspective view of a table assembly of the integrated preparing device of FIG. 1.

As shown in FIG. 3, the table assembly 11 comprises a table board **11*a* and a table support board 11*b*. The table board 11***a* has belts 11*c* for moving web ends, openings 11*d* for passing web edge fastening strips through, and narrow grooves 11*e*. The table support board 11*b* is placed under and close to the table board 11*a* and has two pairs of nipping rollers 11*f* and 11*g*, one pair at each opposite end, which are held to assume both horizontal and vertical alignments. The table board 11*a* is mounted on the table support board 11*b* with rollers therebetween (not shown in drawings) and is capable of being slid in directions perpendicular to the axis of the paper roll.

When the table board 11*a*, positioned above the table support board 11*b*, is slid to the right, the table board 11*a* presses down the nipping rollers 11*g* at the right to make them assume a horizontal alignment and simultaneously removes downward pressure on the nipping rollers 11*f* at the left to make them assume a vertical alignment, enabling them to catch between the rollers a web end travelling to the left on the table board 11*a*.

The table support board 11*b* has an opening 11*h* to provide a space for the web edge fastening strip-attaching device 13 to occupy when it functions.

Figure 4:
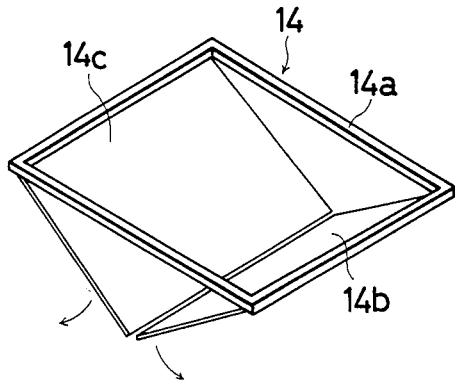
FIG. 4 is a schematic perspective view of a hopper of the integrated preparing device of FIG. 1.

FIG. 4 shows schematically the hopper 14 in a perspective representation, wherein a hopper frame 14*a* has two bottom plates 14*b* and 14*c* which are pivotally held by two opposing sides of a frame and moved by a pneumatic drive means (not shown) when the bottom is opened or closed. When the structural support 8 is folded up at the ceiling, the hopper bottom plates 14*b* and 14*c* overlap substantially in a horizontal position, and when the structural support 8 is extended down, the two bottom plates are released from the closed position with the side edges assuming a triangular form with the hopper frame.

Figure 5:
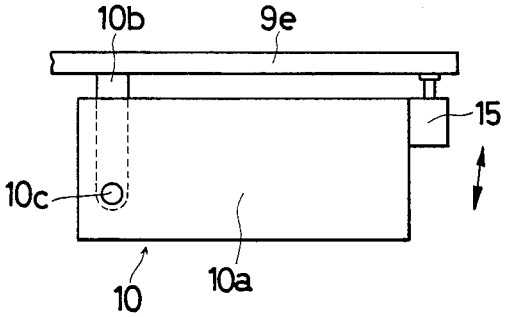
FIG. 5 is a schematic front view of a main preparing device of the integrated preparing device of FIG. 1.

The main preparing device 10 is held by the arm 9 at its foremost end as shown in FIG. 5. More specifically, the housing case 10*a* of the main preparing device 10 is placed under the foremost part of the arm proper 9*b* with the holding guide rail 9*e* therebetween and held on a pivot 10*c* with a holding member 10*b* between the pivot and guide rail. The housing case 10*a* is equipped with a solenoid 15 at the foremost side that, by controlling the exciting current passed therethrough, is designed to make the housing case 10*a* rock on the pivot 10*c* so that when rocking the foremost side of the housing case 10*a* moves for a given distance in the directions shown by the arrows in the diagram.

Figure 6:
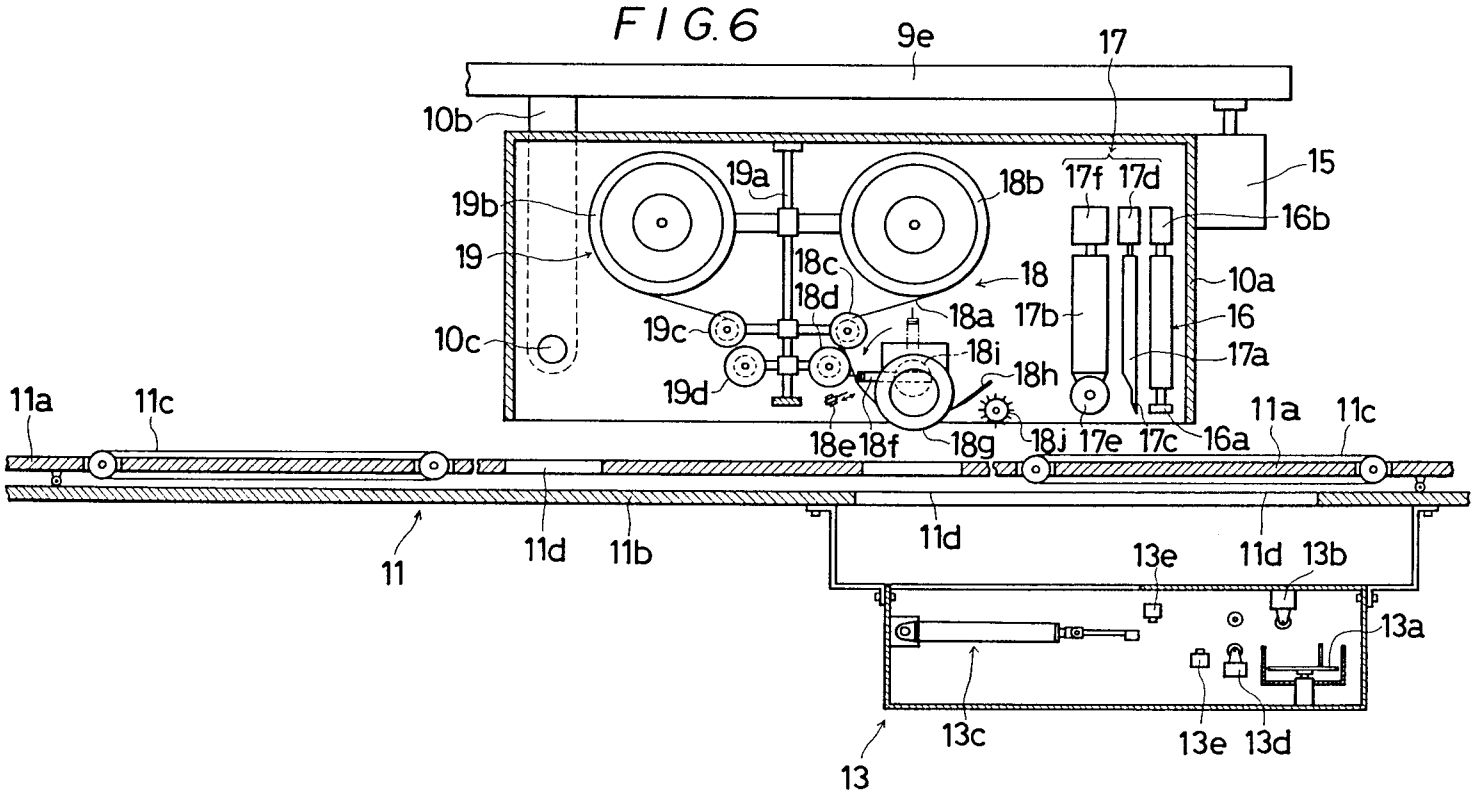
FIG. 6 is a partially cutaway diagram illustrating in detail the inside of the main preparing device of FIG. 5, the table assembly of FIG. 3, and a mechanism of a web edge fastening strip-attaching device of the integrated preparing device of FIG. 1.

As shown in FIG. 6, the main preparing device 10 housed in the housing case 10*a* comprises a suction cup device 16 which lifts up the peripheral web of a paper roll, a cutter device 17 which cuts the peripheral web breadthwise and the web end into a set shape as well, and an adhesive tape-attaching device 18 which applies strips of adhesive tape for web pasting to the leading web end.

The suction cup device 16, housed in position in the hosuing case 10*a*, has a vacuum suction cup 16*a* at one end and a solenoid 16*b* that moves the suction cup in the vertical directions.

The cutter device 17 for the leading web end comprises a cutter element 17*a* for cutting the peripheral web of a paper roll breadthwise and a cutter element 17*b* for cutting the web end into substantially an angle of a triangle. Specifically, the cutter element 17*a* comprises a blade 17*c* that, when the peripheral web is lifted up, is inserted into the opening under the peripheral web and moved across breadthwise to cut the peripheral web, and a solenoid 17*d* that moves the blade 17*c* in vertical directions; the cutter element 17*b* comprises a blade 17*e* for which either a circular blade or a blade with a pointed tip is employed, and a solenoid 17*f* that moves the blade 17*e* in vertical directions.

Whereas the description herein refers to an example wherein two separate cutters 17*a* and 17*b* are employed, a cutter device consisting of one single cutter device applicable to both breadthwise cutting and V-shape cutting may also be introduced as a substitute for the above-described cutting device in practicing the present invention.

The adhesive tape-attaching device 18 comprises a reel 18*b* on which a reel of double side-coated adhesive tape 18*a* is free-rotatably loaded, a guide roller 18*c*, a V-grooved roller 18*d*, a tape cutter 18*e*, a rotation supporting pin 18*f*, a free pressing roller 18*g*, a pin remover 18*h*, a protective-coating-film remover 18*j* for the adhesive tape, and an electric motor 18*i* for rotating the supporting pin.

The double side-coated adhesive tape 18*a*, which is overlayed with removable protective coating film, is drawn from the reel 18*b*, passed over the guide roller 18*c*, and brought onto the V-grooved roller 18*d* where a rotation supporting pin 18*f* is stuck therein. By the turning of the rotating supporting pin 18*f* the adhesive tape 18*a* is brought onto the outer surface of the web end and adhesively attached thereto under pressure from the free pressing roller 18*g*. When the leading end of the adhesive tape 18*a* has been adhesively attached to the web end, the housing case 10*a* glides along the web end in a set direction, the gliding causing the adhesive tape 18*a* to be paid out and adhesively attached to the web end proportionately.

When the leading end of the adhesive tape 18*a* has been adhesively attached to the web end, the rotating supporting pin 18*f* is pulled out of the adhesive tape by a scraper 18*h* and then stops turning for a time until the next cycle. When a given length of the adhesive tape 18*a* has been adhesively attached in position, the rotating supporting pin 18*f* resumes the turning and is stuck into the adhesive tape 18*a* at the V-grooved roller 18*d*. A tape cutter 18*e* is then activated to cut the adhesive tape 18*a* and the housing case 10*a* is glided to such an extent as to make the posterior end of the adhesive tape adhesively attach to the web end.

The protective-coating-film remover 18*j* is activated where necessary to remove the protective coating film overlying the strips of the adhesive tape 18*a* adhesively attached to the leading web end so that the adhesive coating of the pasting strips is exposed.

In FIG. 6, the schematic drawing indicated by 19 represents a device for feeding spare double side-coated adhesive tape, which comprises mainly a turret shaft 19*a* that is designed to be horizontally turned every 180 degrees, a reel 19*b*, a guide roller 19*c*, and a V-grooved roller 19*d*, all the latter-mentioned three parts being supported by the turret shaft 19*a*. A spare reel of double side-coated adhesive tape is loaded on the reel 19*b* and the leading end of said tape is temporarily stuck to the lowest part of the V-grooved roller 19*d*.

When the double side-coated adhesive tape 18*a* on the reel 18*b* has been used up, the turret shaft 19*a* is turned 180 degrees either manually or automatically so that the reel 19*b* takes the place of the reel 18*b*. In an alternative arrangement (not shown), the two devices (the spare double side-coated adhesive tape feeding device consisting of the reel 19*b*, the guide roller 19*c*, and the V-grooved roller 19*d* and the operating device consisting of the reel 18*b*, the guide roller 18*c* and the V-grooved roller 18*d*) are positioned in an alignment perpendicualr to the above-described arrangement; that is, there is provided a supporting frame whereby the operating and spare devices are positioned one behind the other so as to allow the two devices to be used alternatively by moving them along the supporting frame backward and forward.

The paper roll-pressing devices 12 consist of two pressing rollers, each held at each of the opposite ends of the table board 11*a*. These pressing rollers can be lifted and lowered in the vertical directions and when activated apply pressure upon the peripheral web of a paper roll.

The web edge fastening strip-attaching unit 13 is placed under the table support board 11*b*, as shown in FIG. 6, and comprises a fastening strip-loading bed 13*a* which is movable in vertical directions, a protective-coating-film remover 13*b* for the tails of fastening strips which is movable breadthwise, a vacuum suction cup type holder 13*c* in rod form for holding fastening strips which is capable of being extended, drawn backward, circumferentially rotated, pivotally rotated, and extended both vertically and horizontally, a protective-coating-film remover 13*d* for the head of fastening strips, and a protective-coating-film removal inspection device 13*e* for ensuring removal of the protective coating film.

Figure 7A:
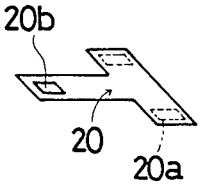
FIG. 7A is an isometric schematic view of a fastening strip applied to a web in a procedure according to this invention.

The fastening strip-loaded bed 13*a* is loaded with a plurality of web edge fastening strips 20 of the configuration of substantially a T as shown in FIG. 7A. To each of these T-shaped fastening strips 20 are attached adhesive pieces 20*a* and 20*b* of protective-film overlaid double side-coated adhesive tape, one piece 20*a* on the lower side of each wing-like flank of the head as well as one piece 20*b* on the upper side of the tail.

Figure 7B:
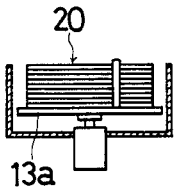
FIGS. 7B, 7B and 7C, 7C' are respectively partially cutaway-side and top views of a strip loading bed and holder with fastening strips of FIG. 7A therein.
Figure 7B:
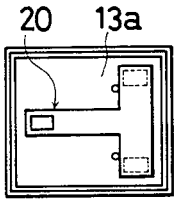

The web edge fastening strips 20 on said loading bed 13*a* are pushed upward piece by piece by means of a cylinder as the attachment proceeds in sequence, as shown in FIGS. 7B and 7B'. When the topmost fastening strip 20 has reached a set position in height, there is lowered a tail protective-coating-film remover 13*b* equipped with a roller remover designed to rotate slowly, whereby the protective-coating film is peeled off the double side-coated adhesive tape on the tail 20*b* under pressure given by the roller remover as it rolls over the tail, as shown in FIGS. 7C and 7C'.

Figure 7D:
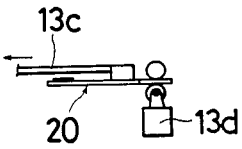
FIGS. 7D, 7D', 7E, 7F, and 7G are respectively side, top, side, side, and side views of a suction cup holder and associated structure of the integrated preparing device of FIG. 1 shown in various modes of applying the fastening strip of FIG. 7A.
Figure 7D:
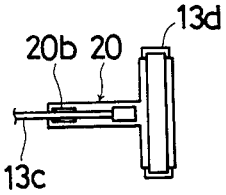
Figure 7C:
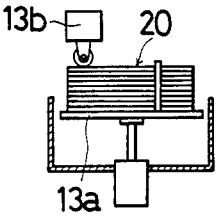
Figure 7C:
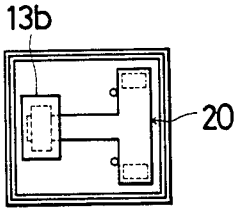

When the protective-coating film has been removed from the adhesive tape 20*b* on the tail in the manner described above, the vacuum suction cup type holder 13*c* is activated to hold the fastening strip and pass it over and past a protective-coating-film remover for the head 13*d* in the direction shown by an arrow in FIG. 7D so as to peel the protective-coating film off the double side-coated adhesive tape on the head 20*a* under pressure given by the roller remover as it rolls under the head, as shown in FIGS. 7D and 7D'.

Figure 7E:
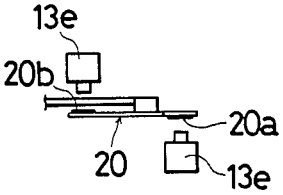

After removal of the protective-coating-film from the adhesive tape at each wing-like flank of the head and the tail, the fastening strip 20 is moved past photoelectric devices 13*e* which inspect the adhesive tapes to ensure that the protective-coating-film has been removed, as shown in FIG. 7E.

Figure 7F:
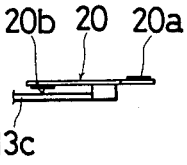
Figure 7G:
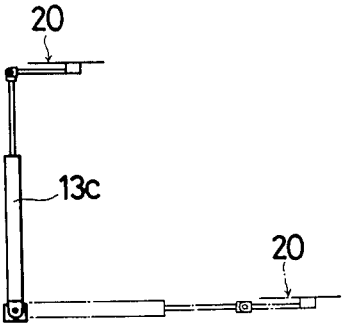

After passing the photoelectric inspection devices 13*e*, the fastening strip held by the vacuum suction cup type holder 13*c* is turned upside down as the holding rod 13*c* circumferentially turns 180 degrees, the adhesion side of the head turned up and that of the tail turned down, as shown in FIG. 7F. This turn of the holding rod 13*c* is followed by a pivotal upward turn of the same by 90 degrees by action of a cylinder and simultaneously by a pivotal pivoting of the forward part of the same rod by 90 degrees, thereby the lower part of the holding rod 13*c* assumes a vertical position and its forward part a horizontal position, so that the fastening strip 20 is then held horizontally, as shown in FIG. 7G. Next, with upward movement of the piston in the rod the suction cup is raised higher and passed through an opening 11*d* provided in the table assembly 11 for the passage of the fastening strip as shown in FIG. 6, and the fastening strip is adhesively attached, with downward pressure from the free pressing roller 18*g* as well as the upward pressure, to the inner side of the leading web end with the tail to the part adjacent to the web edge of the paper roll.

An example embodying the present invention for preparing paper rolls for web pasting with respect to the process in sequence is now described hereunder.

As shown in FIG. 1, where a paper roll 4 rotatably held on a reel stand 5 is to be prepared for web pasting by extending the vertical folding support 8, the paper roll preparing device 1 is brought down appropriately and the nearer end of the table board 11*a* is slid close to (to the right in FIG. 1) the periphery of the paper roll 4. At the same time the arm proper 9 is stretched so as to set the main preparing device 10 in position for the subsequent processing while the hopper 14 is opened.

Figure 8A:
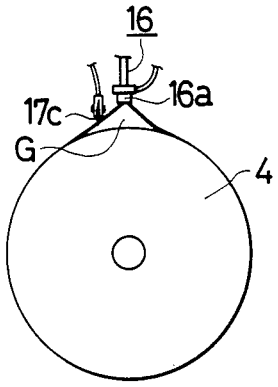
FIG. 8A is a side view of a suction cup device lifting a layer of a paper roll in preparation for being cut by a blade, in operation of the integrated device of FIG. 1.

Next, as shown in FIG. 8A, the vacuum suction cup device 16 is activated to lift up the outermost web of the paper roll 4 by the suction cup 16*a*. The blade 17*c* of the cutter 17*a* constituting a part of the cutter unit 17 is then inserted into the opening G produced by the suction cup lifting of the outermost web and by deactivating the suction cup and moving the main preparing device 10 breadthwise the outermost web is cut across. The loose web thus cut off is moved along the table unit 11 (to the left in FIG. 1) by means of belts 11*c* in the table unit 11 as well as a drive means rotating the paper roll on the reel stand 5 and through the nipping rollers 11*f* placed at the opposing end (the left end in FIG. 1) of the table support board 11*b* the waste web is sent into the hopper 14.

The leading web end is then moved along the table board 11*a* (to the left in FIG. 1) by means of belts 11*c* in the table assembly as well as the drive means rotating the paper roll, and when the web edge is caught by the nipping rollers 11*f* the movement of the web is stopped.

Figure 8B:
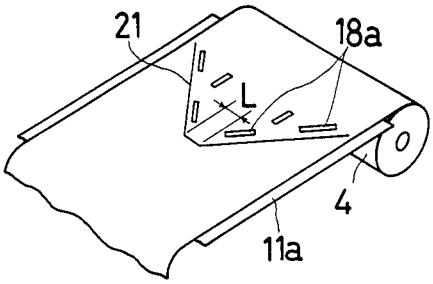
FIGS. 8B and 8C are isometric views of a paper roll and a table board of the integrated device of FIG. 1 depicting the manner in which tape and fastening strips are adhered to the leading web end of the roll in preparation for pasting.

When the web edge has been caught as described above, the adhesive tape-attaching device 18 housed in the main preparing device 10 is activated to adhesively attach strips of double side-coated adhesive tape 18*a* for web pasting to the outer side of the web end at the positions in sequence according to a set arrangement, as shown in FIG. 8B.

Simultaneously with the above-described attachment of double side-coated adhesive tapes, an incision substantially in the shape of an angle of a triangle is formed in the web end by the use of the cutter 17*b* of the cutter device 17. After forming this V-shaped incision 21, the nipping rollers 11*f* are rotated so as to remove the waste portions from the web end. The lengthwise space in the middle indicated by L in FIG. 8B is set apart as a path for the drive belt D by means of which the paper roll is rotated for pasting to an expiring web.

Figure 8C:
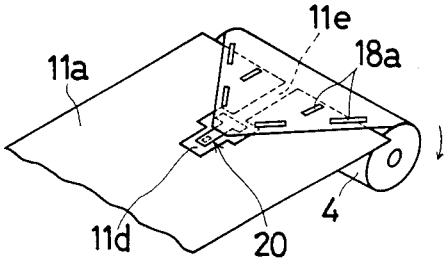
Figure 10:
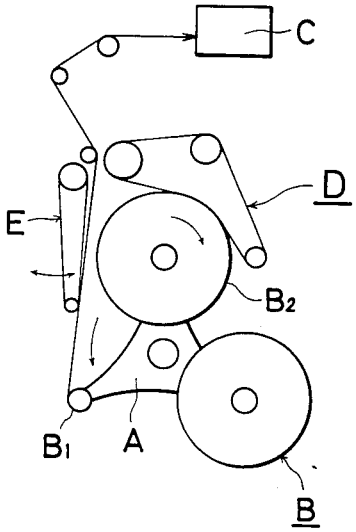
PRIOR ART FIG. 10
FIG. 10 illustrates schematically the manner in which a new paper roll is pasted to an expiring web; and, FIG. 11 is a schematic perspective view of a paper roll manually prepared for web pasting.
Figure 9:
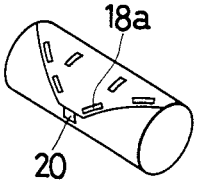
FIG. 9 is a schematic perspective view of a paper roll prepared for web pasting according to principles of this invention.
Figure 11:
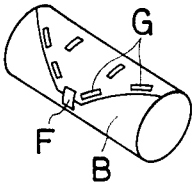
PRIOR ART FIG. 11

During the time when the main preparing device 10 prepares the leading web end as described above, the web edge fastening strip-attaching device 13 positioned under the table assembly 11 adhesively attaches a fastening strip 20 to the inner side of the V-shaped web edge in the middle, as shown in FIG. 8C. The web end is then drawn back on the paper roll by a reverse drive acting on the paper roll on the reel stand 5. The paper roll-pressing device 12 applies pressure peripherally on the paper roll 4 when the paper roll is turned backward so that the tail of the fastening strip 20 is fixed to the position adjacent to the foremost web edge on the paper roll 4 with a double-side coated adhesive tape 20*b* therebetween. FIG. 9 schematically shows a paper roll with the web edge fastened in position in the manner described above.

What is claimed is:

1. A device in a printing system for preparing paper rolls held on a reel stand for web pasting which comprises:

a folding support capable of being extended and folded vertically that supports in suspension the remainder of said device for preparing paper rolls for web pasting;

an arm held by said folding support, whose foremost end is capable of being moved in directions both parallel to and perpendicular to the axis of a paper roll on the reel stand;

a vacuum suction cup device held by said arm for lifting up the outermost web of the paper roll;

a cutter device held by said arm for cutting the outermost web of the paper roll;

an adhesive tape-attaching device held by said arm for adhesively attaching adhesive tapes for web pasting to the leading web end of the paper roll;

a table assembly positioned under said arm and held by said folding support;

a web edge fastening strip-attaching device positioned under said table assembly and held by said folding support for adhesively attaching one end portion of a fastening strip to the inner side of the leading web end of the paper roll; and, a paper roll-pressing device for adhesively attaching the other end portion of said web edge fastening strip to the outer surface of the paper roll.

2. A device as claimed in claim 1, wherein a main preparing device comprising said vacuum suction cup device, said cutter device and said adhesive tape-attaching device is held by said arm in such a manner as to be movable relative to said reel stand.

3. A device as claimed in claim 1, wherein said cutter device comprises a cutter for cutting the peripheral web of a paper roll breadthwise and a cutter for cutting the web end into a V-shape.

4. A device as claimed in claim 1, wherein said adhesive tape-attaching device includes a spare adhesive tape feeding device.

5. A device as claimed in claim 1, wherein said table assembly has a table board which is capable of being slid in directions perpendicular to the axis of the paper roll.

6. A device as claimed in claim 1, wherein said adhesive tapes attached by said adhesive tape-attaching device includes a protective coating-film overlayed thereon for inhibiting its attachment.

7. A device as in claim 6, wherein said adhesive tape-attaching device includes a protective coating-film remover for removing said protective coating-film overlying said adhesive tapes adhesively attached to said leading web end.

* * * * *